US009282818B2

(12) United States Patent
Sock et al.

(10) Patent No.: US 9,282,818 B2
(45) Date of Patent: Mar. 15, 2016

(54) FURNITURE ENSEMBLE WITH SOFA TABLE ISLAND

(71) Applicant: L. & J. G. Stickley, Inc., Manlius, NY (US)

(72) Inventors: Ronald L. Sock, High Point, NC (US); William E. DeBlaay, Manlius, NY (US)

(73) Assignee: L. & J. G. Stickley, Inc., Manlius, NY (US)

( * ) Notice: Subject to any disclaimer, the term of this patent is extended or adjusted under 35 U.S.C. 154(b) by 0 days.

(21) Appl. No.: 14/494,656

(22) Filed: Sep. 24, 2014

(65) Prior Publication Data

US 2016/0007746 A1 Jan. 14, 2016

Related U.S. Application Data

(63) Continuation-in-part of application No. 29/496,008, filed on Jul. 8, 2014.

(51) Int. Cl.

| | |
|---|---|
| ***A47B 83/02*** | (2006.01) |
| ***A47C 9/00*** | (2006.01) |
| ***A47B 83/04*** | (2006.01) |
| ***A47C 7/00*** | (2006.01) |
| ***A47C 17/86*** | (2006.01) |
| ***A47C 17/00*** | (2006.01) |

(52) U.S. Cl.

CPC . *A47B 83/04* (2013.01); *A47C 7/00* (2013.01); *A47C 17/00* (2013.01); *A47C 17/86* (2013.01)

(58) Field of Classification Search

CPC ..... A47B 83/04; A47C 17/00; A47C 17/86; A47C 7/00

USPC ..... 297/140, 163, 232, 440.1, 440.14, 461, 297/135; 312/317.1

See application file for complete search history.

(56) References Cited

U.S. PATENT DOCUMENTS

| | | | | | |
|---|---|---|---|---|---|
| 2,024,045 | A | * | 12/1935 | Johnson | A47B 83/02 248/416 |
| D102,971 | S | * | 1/1937 | Hale | D6/336 |
| D145,657 | S | * | 10/1946 | Case | 297/188.19 |
| D148,242 | S | * | 12/1947 | Horsewood | D6/336 |
| 2,461,684 | A | * | 2/1949 | Dierickx | A47B 83/045 297/140 |
| 2,495,849 | A | * | 1/1950 | Kris | A47C 17/02 297/135 |
| D166,463 | S | * | 4/1952 | Goulart | D6/336 |
| 2,614,018 | A | * | 10/1952 | Engel | A47B 83/045 108/33 |
| D174,341 | S | * | 3/1955 | Michlin | 297/163 |
| D181,640 | S | * | 12/1957 | Gelbspan et al. | D6/336 |
| 3,041,633 | A | * | 7/1962 | Bendell | A47B 83/04 5/2.1 |
| 3,341,198 | A | * | 9/1967 | Turpin, Sr. | A63D 15/04 297/163 |
| 3,479,083 | A | * | 11/1969 | Lafer | A47B 3/14 108/63 |

(Continued)

*Primary Examiner* — Rodney B White

(74) *Attorney, Agent, or Firm* — Bernhard P. Molldrem, Jr.

(57) ABSTRACT

A furniture ensemble includes a tuxedo sofa, a two-level sofa table island piece adapted to be disposed behind the tuxedo sofa, stools or other additional seating behind the sofa table island piece, and an ottoman or, alternatively, a cocktail table with nesting footstools for further seating. The sofa table island piece has a front horizontal shelf member supported between left and right side walls and a rear counter top member a few inches higher than the front shelf. The front horizontal shelf member of the island piece is at the same level as the top of the sofa back. An open space is formed below the counter top member. Stools or similar seating units with their seat portions higher than the sofa seating space are removably stored in the island piece. This group provides seating for a group of persons with an unobstructed view of activities taking place ahead of the furniture ensemble.

17 Claims, 9 Drawing Sheets

(56) References Cited

U.S. PATENT DOCUMENTS 3,592,520 A * 7/1971 Marino ..... A47B 83/02 108/103
D224,764 S * 9/1972 Rowland ..... D6/373
3,817,573 A * 6/1974 Facury ..... A47C 3/04 108/62
D239,580 S * 4/1976 Robertson ..... D6/371
3,951,449 A * 4/1976 Crowther ..... A47B 83/02 297/142
D270,314 S * 8/1983 Helland ..... D6/381
D278,003 S * 3/1985 Gagliano ..... D6/336
4,619,005 A 10/1986 Rutens
4,925,256 A * 5/1990 Vargas ..... A47B 27/02 297/163
5,115,924 A * 5/1992 Konig ..... A47B 57/04 211/186
D327,985 S * 7/1992 Harris ..... D6/335
D338,349 S * 8/1993 Warnock ..... D6/335
D347,529 S * 6/1994 Hachenberg ..... D6/334
D350,857 S * 9/1994 Warren ..... D6/336
D360,311 S * 7/1995 Stamberg ..... D6/334
D367,566 S * 3/1996 Walters, III ..... D6/336
5,601,348 A * 2/1997 Minkovski ..... A47B 83/04 108/42
5,927,835 A * 7/1999 Mergold ..... A47B 83/045 297/142
6,102,475 A * 8/2000 Hamann ..... A47B 83/02 108/27
D432,817 S 10/2000 Gallien
D441,204 S * 5/2001 Bernich ..... D6/334
D469,968 S * 2/2003 Van Den Reek ..... D6/370
D512,573 S * 12/2005 Koenig ..... D6/335
D520,770 S * 5/2006 Nastri ..... D6/381
D526,803 S * 8/2006 Lee ..... D6/381
D530,929 S * 10/2006 Resterhouse ..... D6/336
D544,237 S * 6/2007 Nemschoff ..... D6/381
D546,576 S * 7/2007 Grabe ..... D6/381
D584,072 S 1/2009 Mohundro
D584,073 S 1/2009 Mohundro
D615,767 S * 5/2010 Griepentrog ..... D6/381
7,758,128 B2 * 7/2010 Schwartz ..... A47B 83/00 297/239
D675,459 S * 2/2013 Martin ..... D6/381
8,366,200 B2 2/2013 Schwartz
D677,477 S * 3/2013 Agati ..... D6/336
D693,150 S * 11/2013 Johnson ..... D6/648
D701,052 S * 3/2014 Breij ..... D6/336
8,740,299 B1 * 6/2014 Hall ..... A47B 3/06 297/135
8,752,900 B2 * 6/2014 Carter, III ..... A47C 13/005 297/440.14
D722,445 S * 2/2015 Baraldi ..... D6/336
8,950,817 B2 * 2/2015 Iacovoni ..... A47B 83/02 297/135
D731,192 S * 6/2015 Sorel ..... D6/338
D738,130 S * 9/2015 Starck ..... D6/381
2005/0140184 A1 * 6/2005 Williams ..... A47C 13/00 297/135
2008/0303394 A1 * 12/2008 Woods ..... A47B 96/00 312/317.1
2011/0204756 A1 * 8/2011 DeMars ..... A47F 9/00 312/140.2
2014/0375088 A1 * 12/2014 Fuchs ..... A47B 85/04 297/125

* cited by examiner

FURNITURE ENSEMBLE WITH SOFA TABLE ISLAND

This is a Continuation-in-Part of application Ser. No. 29/496,008, filed Jul. 8, 2014, the disclosure of which is incorporated by reference herein.

BACKGROUND OF THE INVENTION

This invention relates to furniture and seating units, e.g., couches, chairs, settees and sofas, and to associated furniture pieces such as ottomans, footstools, sofa tables and console tables. The invention is more specifically directed to a combination of furniture pieces that include at least a sofa (in the described embodiment, a "tuxedo sofa" having wide arms and a low back with its top at the same level as the arms), and a dual-level sofa table piece, also called an "island" piece or Gathering Island, positioned immediately behind the back of the sofa. This island piece has a front shelf member that serves as a table or shelf space, immediately behind the sofa, for lamps, books, or the like, and as a place where persons seated on the sofa can place food or drink items, or keep their smart phones, tablets, or other devices. End tables, i.e., to the sides of the sofa, are then not needed. The sofa table island piece also has a back counter top surface, at a level several inches above the level of the front shelf member. The back counter top also creates an open space beneath it within the sofa table island piece, where a few stools or other seating can be stored, and can be taken out and used for seating of other persons behind the sofa table island piece, or to the side of the sofa.

An ottoman may be positioned ahead of the sofa, and preferably can be the same height as the seating portion of the sofa, and also can have the same width. Alternatively, a cocktail table may be placed at that location, with a number of footstools or similar low seating that are designed to nest in receptacle spaces beneath the top of the cocktail table. These footstools can be used as additional seating ahead of the sofa.

This arrangement can be used to advantage when a moderate to large number of friends, family members, and guests are present for an event. Several persons can be seated on the sofa, others seated on the stools behind the sofa table island piece, and others may be seated on the wide arms of the sofa, and on the ottoman or on the low-seating footstools. This arrangement may be used so the entire group can watch a sporting event on a large-screen television, or the opening of presents on Christmas morning, or for a musical performance or recital. The height of the stools, sofa seating, ottoman, and footstools is such that the persons present will all have a clear line of sight at the event.

To date, no combination of furniture pieces has been proposed or constructed that can function this way in a satisfactory manner.

Specifically, no one has previously proposed a sofa table or similar furniture unit that satisfies the needs of the persons seated on a sofa ahead of that furniture unit, and also the needs of person seated on stools or similar seating, at a higher seating level, behind the furniture unit.

OBJECTS AND SUMMARY OF THE INVENTION

Accordingly, it is an object of this invention to provide a combination of furniture units that achieve the seating of a group of persons that may be assembled to observe an event such as described, and which combination overcomes the drawbacks of the prior art.

Another object of this invention is to provide a furniture piece, in the nature of a sofa table or island piece, which unifies the seating pieces, such as the tuxedo sofa, placed ahead of the island piece, and movable seating units at a higher seating level, e.g., stools, positioned behind the island piece.

According to an aspect of this invention, the combination includes a tuxedo sofa, a sofa table island piece, and movable seating units that may be stored within the sofa table island piece.

The tuxedo sofa is adapted for seating a plurality of persons, having a frame, and defining a seating space of a predetermined height and width, with arms disposed at left and right sides of the seating space. Each of the arms has a substantially flat (horizontal) top surface of a given width and a predetermined height above the height of said seating space. A sofa back is disposed behind the seating space and has a horizontal top surface of a predetermined width and a height the same as the height of arm top surfaces.

A two-level sofa table island piece is adapted to be disposed immediately behind the sofa back of the tuxedo sofa. This sofa table island piece is constructed with left and right side walls; a front horizontal shelf member affixed onto the side walls and extending in a width direction a distance at least equal to the width of the sofa seating space. This shelf has a height to match (i.e., equal) the height of the top surface of the sofa back, so that the front horizontal shelf member will be at the same level as the sofa back top surface when the sofa table island piece is positioned directly behind the tuxedo sofa. A vertical riser wall extends upward from the rear edge of the front horizontal shelf member, and a rear horizontal counter member extends rearwardly from the upper edge of the riser wall. This counter member extends laterally in the width direction a distance at least equal to the width of the sofa seating space. The counter member has a height greater than the height of the front horizontal shelf member, and can serve as a counter or work surface for persons seated (or, in some cases, standing) behind the sofa table island piece. Also, the two side walls and the rear counter member define an open space suitable for storing two or more stools or similar seating units.

A plurality of movable seating units are stored inside the space or cavity at the back of the sofa table island piece, and can be easily pulled out from the open back for use for seating persons behind the island piece. Favorably, these seating units each have a seat portion supported on a leg portion such that the seat portion is at a height greater than the height of the sofa seating space. This seating arrangement positions those persons higher than those on the sofa, so they can have an unobstructed view of a program or game on the video screen or other event happening in the front of the furniture ensemble.

In a favorable embodiment, the sofa table island piece further can have one or more horizontal shelves mounted on at the side walls thereof at the level of front horizontal shelf member, and also at a position below the horizontal shelf member.

In one preferred embodiment the height of the front horizontal shelf member of the sofa table island member is substantially 27 inches, and the height of the rear counter member is substantially 36 inches. The horizontal top surfaces of the arms of said sofa have a width of substantially 12 inches, and can serve as informal seating.

The sofa table island piece is favorably provided with a cord slot formed at a rear side of the front horizontal shelf member, so as to define a space for passage or electric or communication cords or cables between the front horizontal shelf member and the vertical riser wall, serving as a means for minimizing cord clutter when lamps, cell phone chargers, or other powered items are placed on the front or side shelves of the island piece. Preferably, the cord slot has a wide portion of greater dimension than remainder of the cord slot for permitting passage of a cord connector, i.e., an electrical plug or cable connector. Positioned at the corner of the riser and front shelf member, the cord slot or slots are not particularly noticeable, and do not detract from the appearance of the island piece.

The combination can further comprise an ottoman adapted to be positioned in front of the seating space of the tuxedo sofa. Favorably the ottoman has width and height that are substantially the same as the width and height of the seating space of the sofa.

In addition or alternatively, the combination may comprise a cocktail table adapted to be positioned in front of the seating space of the tuxedo sofa, together with two, three, or four footstool members. In this case, the cocktail table is configured so as to define a number of nesting spaces for the footstools beneath the table top of the cocktail table, where the footstools can be stored until needed.

These and other objects, features, and advantages of the invention will become apparent from the following detailed description of a selected preferred embodiment, which is to be read in connection with the accompanying Drawing:

DETAILED DESCRIPTION OF THE PREFERRED EMBODIMENTS

Figure 1:
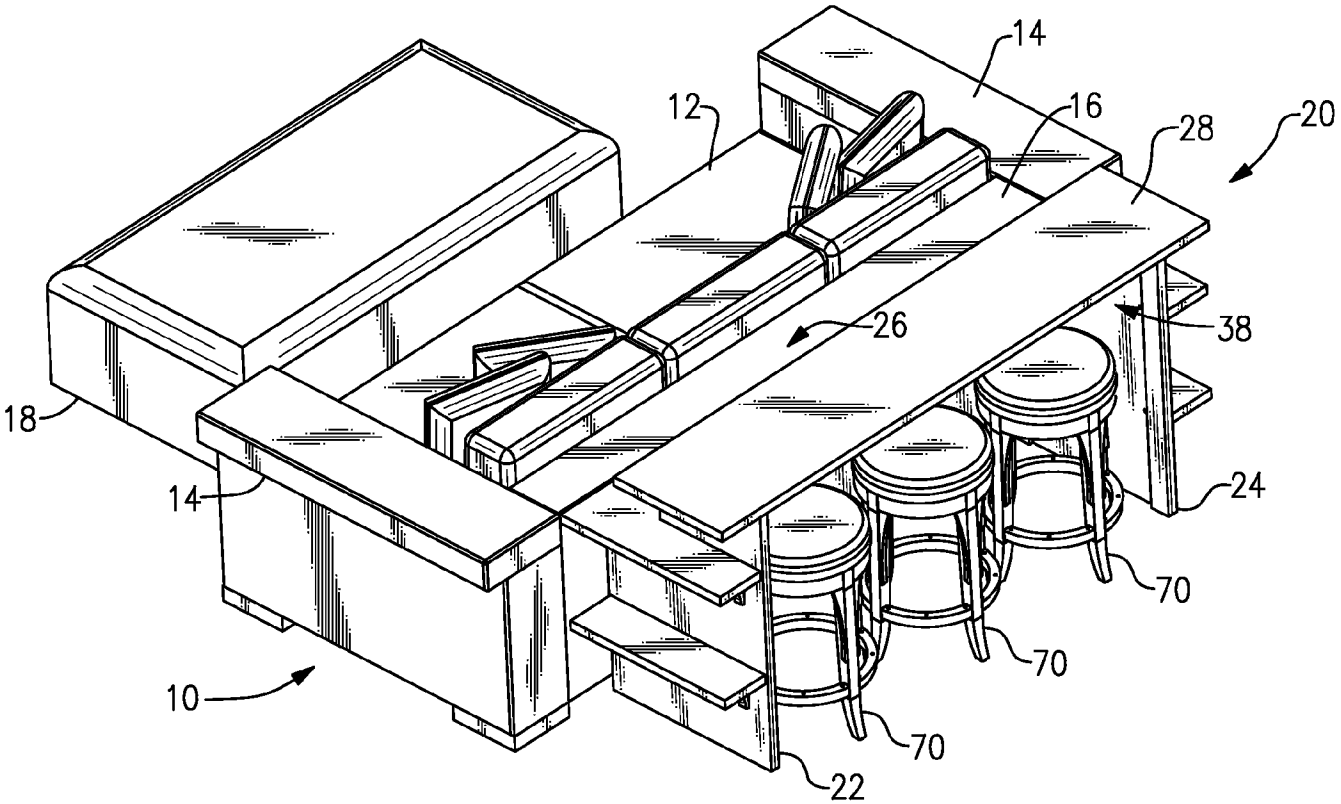
FIG. 1 is a perspective view of an ensemble of furniture according to one exemplary preferred embodiment of the present invention.
Figure 2:
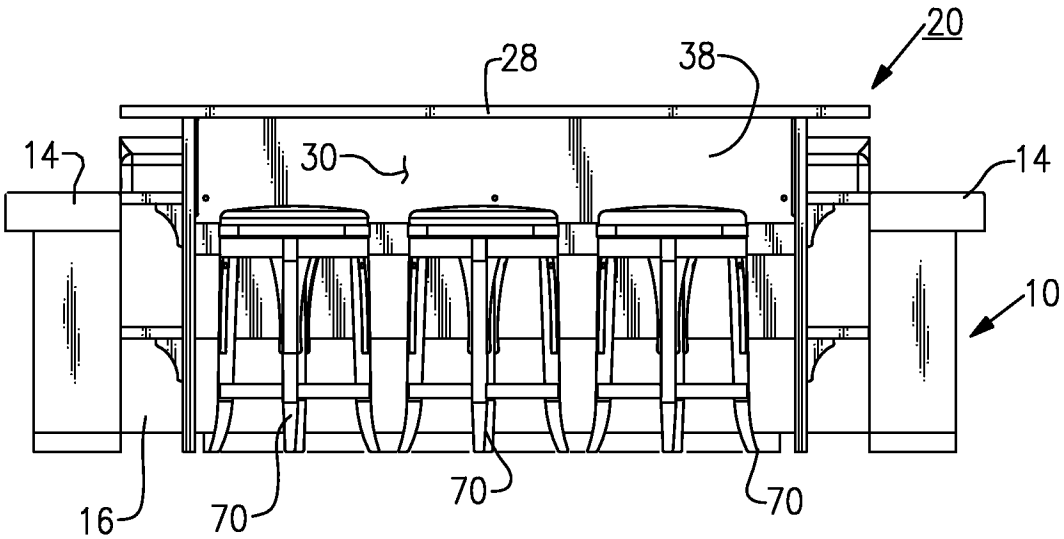
FIG. 2 is a rear elevational view thereof.
Figure 3:
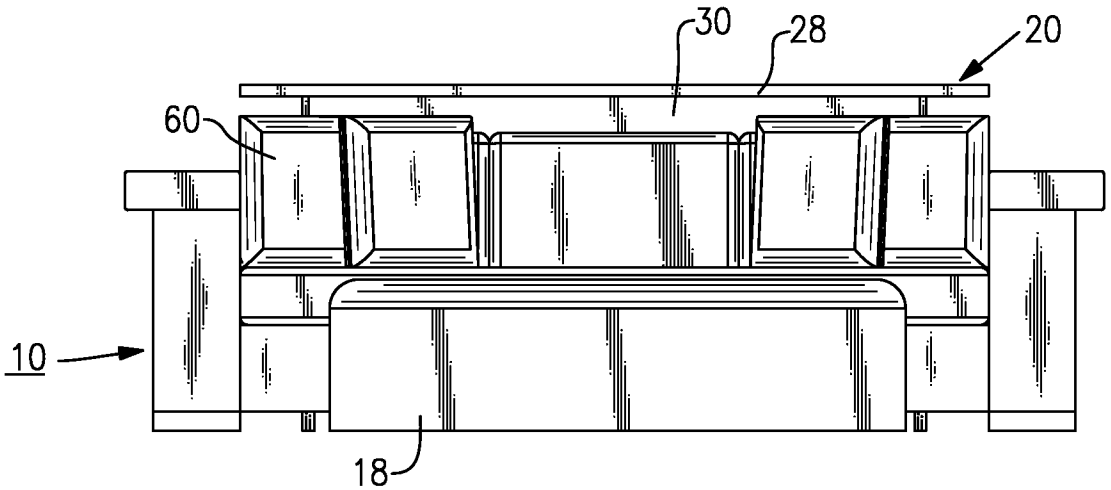
FIG. 3 is a front elevational view thereof.
Figure 4:
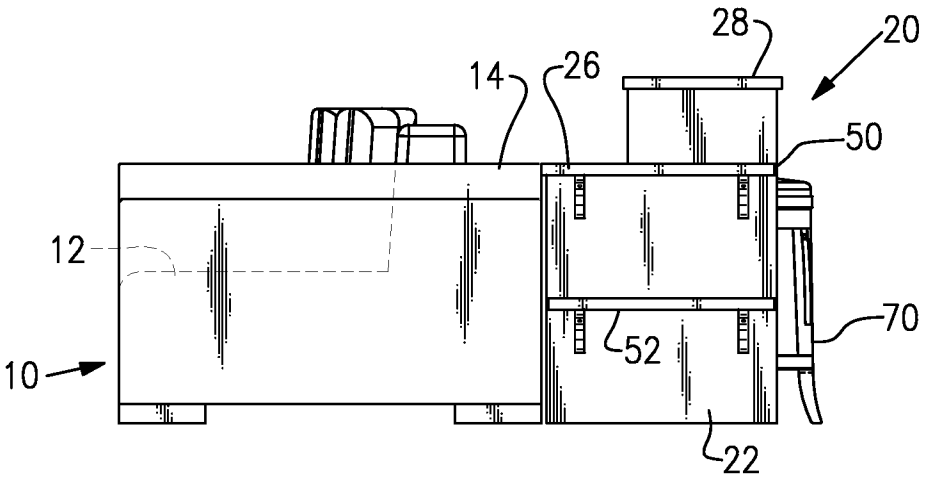
FIG. 4 is a side elevational view of the sofa table island piece of this embodiment.
Figure 7:
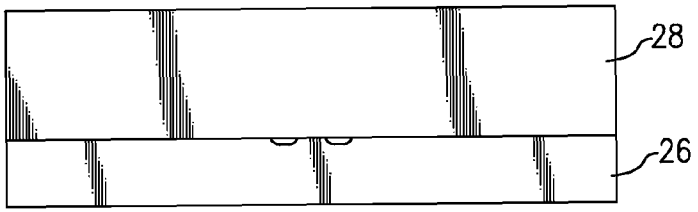
FIGS. 6, 7, and 8 are a side elevation, top plan, and rear elevation thereof.
Figure 5:
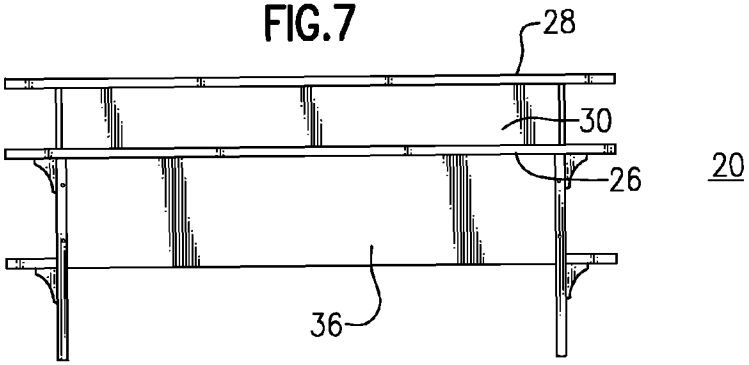
FIG. 5 is a front elevational view of the sofa table island piece of this embodiment.
Figure 8:
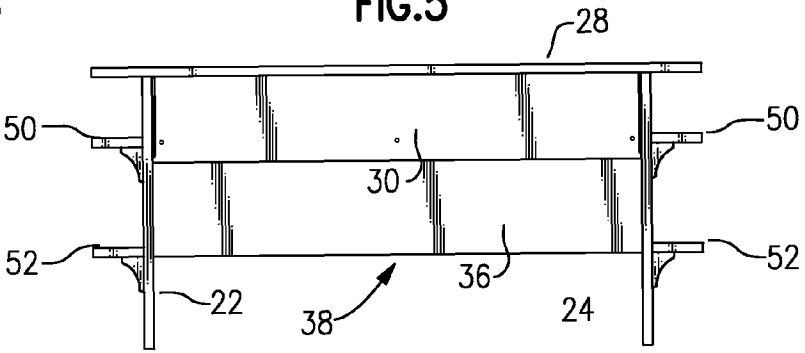
Figure 6:
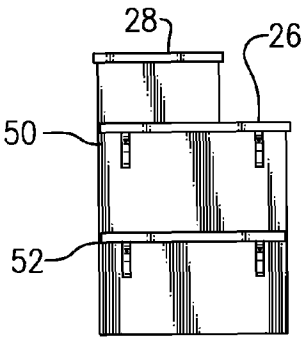

With reference to the Drawing Figures, and initially to FIGS. 1 to 4, a sofa 10, here a so-called Tuxedo sofa, is shown to have a wide seating area 12 with one or more seat cushions, and with arms 14 positioned at left and right ends, and a sofa back 16 behind the seating area 12 and extending between the rear portions of the two sofa arms 14. In this case, the arms each rise more or less vertically to a wide top surface that is about generally flat and about ten to twelve inches in width, and at a height of about twenty-seven inches above the floor. The sofa back 16 also rises vertically and has a wide flat top surface of about ten to twelve inches front-to-back and at a height to match the side arms (i.e., twenty-seven inches).

In this embodiment, an ottoman 18 is positioned in front of the sofa 10, and has a height and width to match the seating area 12 of the sofa. A number of pillows, cushions and bolsters on the sofa can repositioned by persons seated on the sofa.

Immediately behind the back 14 of the sofa 10 is a two-level sofa table or island piece 20, serving as a connecting piece between the sofa 10 and additional seating for persons behind the sofa table island piece 20, that is, for persons who may be seated on additional seating such as stools 70.

As shown additionally in FIGS. 5 to 8, the sofa table island piece 20 has left and right side walls 22 and 24, with a staggered top edges higher at the rear side. A front shelf 26 is supported on the front part of the side walls and extends horizontally, i.e., left to right, at a height of twenty-seven inches so as to be at the same height as the back top surface of the back 16 of the sofa 10. In this embodiment the left-to-right distance of the shelf 26 matches the width of the sofa back 14. The shelf extends front-to-back between eight and twelve inches, and its front edge is at the position of the front edge of the two side walls 22 and 24. In this embodiment, the side walls are each one piece and solid across their width, but in other possible embodiments they could have one or more open sections.

An upper, rear counter top or shelf 28 extends across the top rear of the two side walls 22, 24 at a height above the level of the front shelf 26, and in this embodiment the counter top 28 is about thirty-six inches above the floor. A riser panel 30 extends up from the rear edge of the front shelf 26 to the front edge of the upper counter top 28, and a lower panel 36 beneath the front edge of the lower front shelf 26 extends downward and also extends from the left side wall 22 to the right side wall 24. The rear side of the sofa table island piece 20 is open beneath the upper rear counter top 28 and the two side walls 22 and 24 to create an open space 38 for storage of additional seating and to create leg room for persons seated at the rear counter top 28.

Figure 9:
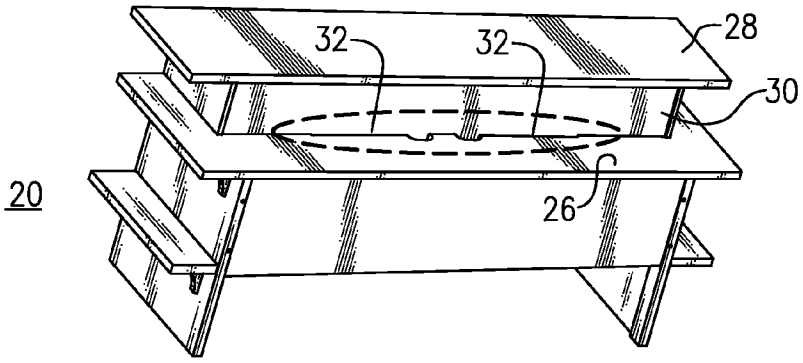
FIG. 9 is a front perspective of the sofa table island piece featuring the cable slot(s).
Figure 9A:
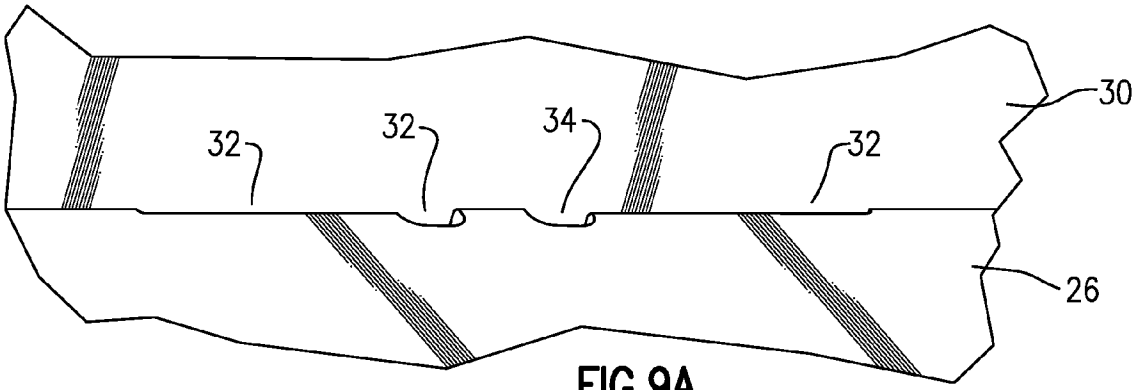
FIG. 9A is an enlargement of a portion of FIG. 9 showing detail of the cable slots(s).

Referring now to FIGS. 9 and 9A, at the junction of the lower front shelf 26 and the riser panel 30 there is are narrow cord slots or cutouts 32 formed, one at each side of the center of the shelf and riser, and these cord slots 32 are intended to create a passage for electrical cords and/or communications cables for lamps, digital devices, etc. that persons may have present on the sofa table island piece 20. At the end of each of these cord slots or cutouts 32 nearer the center of the island piece there is an enlarged portion 34 to permit a plug or cable connector to pass through. The cord slots help keep cord clutter or tangle from the top and outer surfaces of the island piece furniture unit.

Referring again to FIGS. 4 to 8, the sofa table island piece unit 20 has upper side shelves 50 disposed respectively at the upper parts of the right and left side walls 22, 24 and contiguous with the ends of the front shelf 26. These are supported by brackets (not numbered) that are fastened to the outer surface of the side walls. Beneath these shelves are lower side shelves 52, and associated support brackets. These side shelves 50 and 52 can provide places for books or other articles (See FIG. 10).

Figure 10:
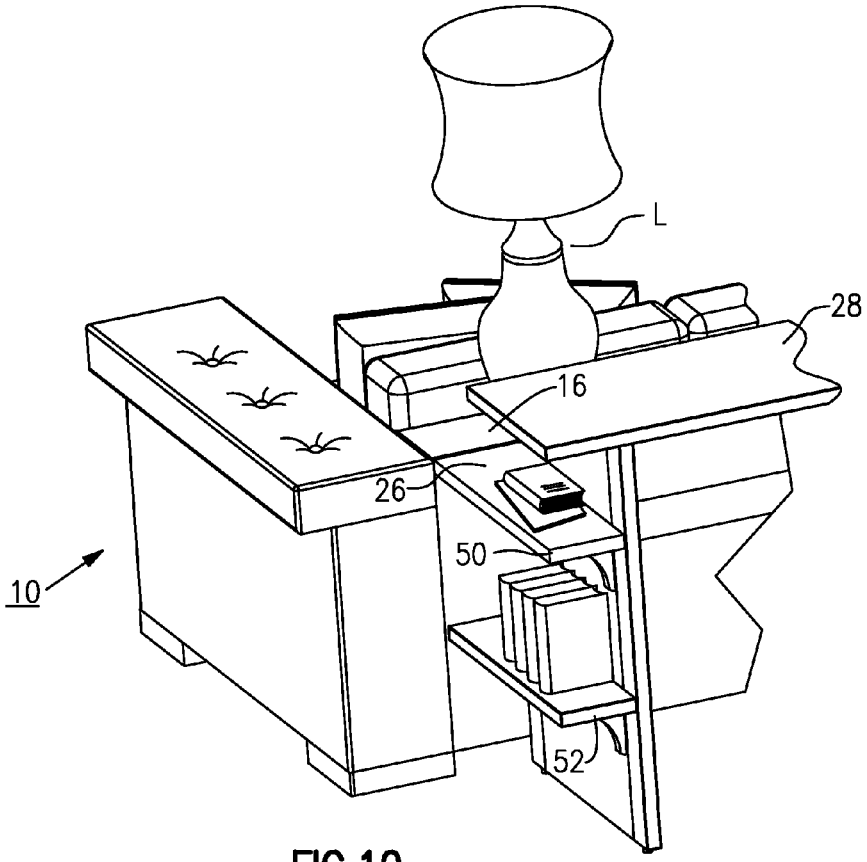
FIGS. 10, 11 and 12 are environmental perspective views of the sofa and sofa table island piece of this embodiment.
Figure 11:
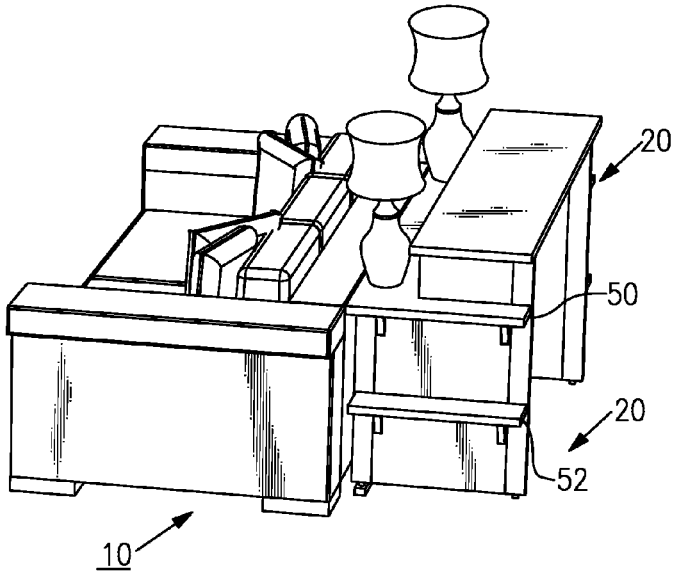
Figure 12:
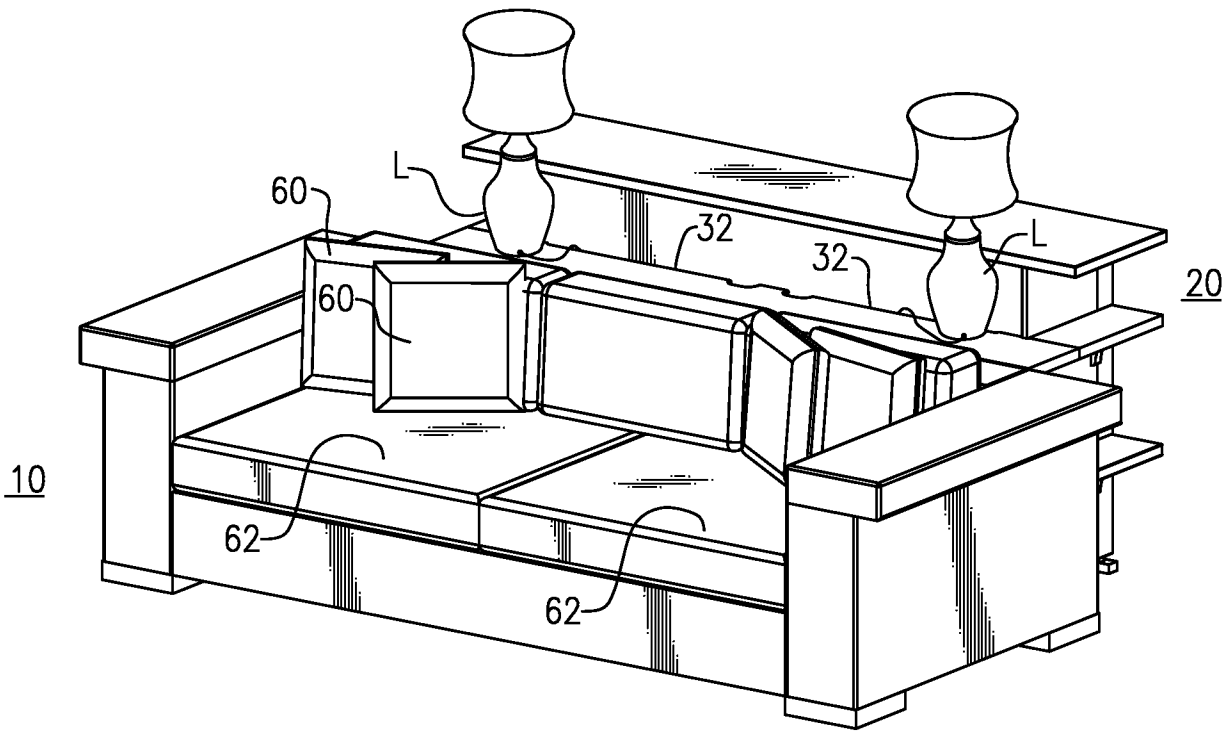

Pillows 60, rear cushions, and other movable cushions such as bolsters can be present as shown in FIGS. 10 to 12, and can be repositioned as desired for occupant comfort. Also shown in FIG. 12 are sofa seat cushions 62, of which there are two in this embodiment. Of course in other embodiments the sofa may be designed to have only a single cushion, or perhaps three cushions.

Figure 13:
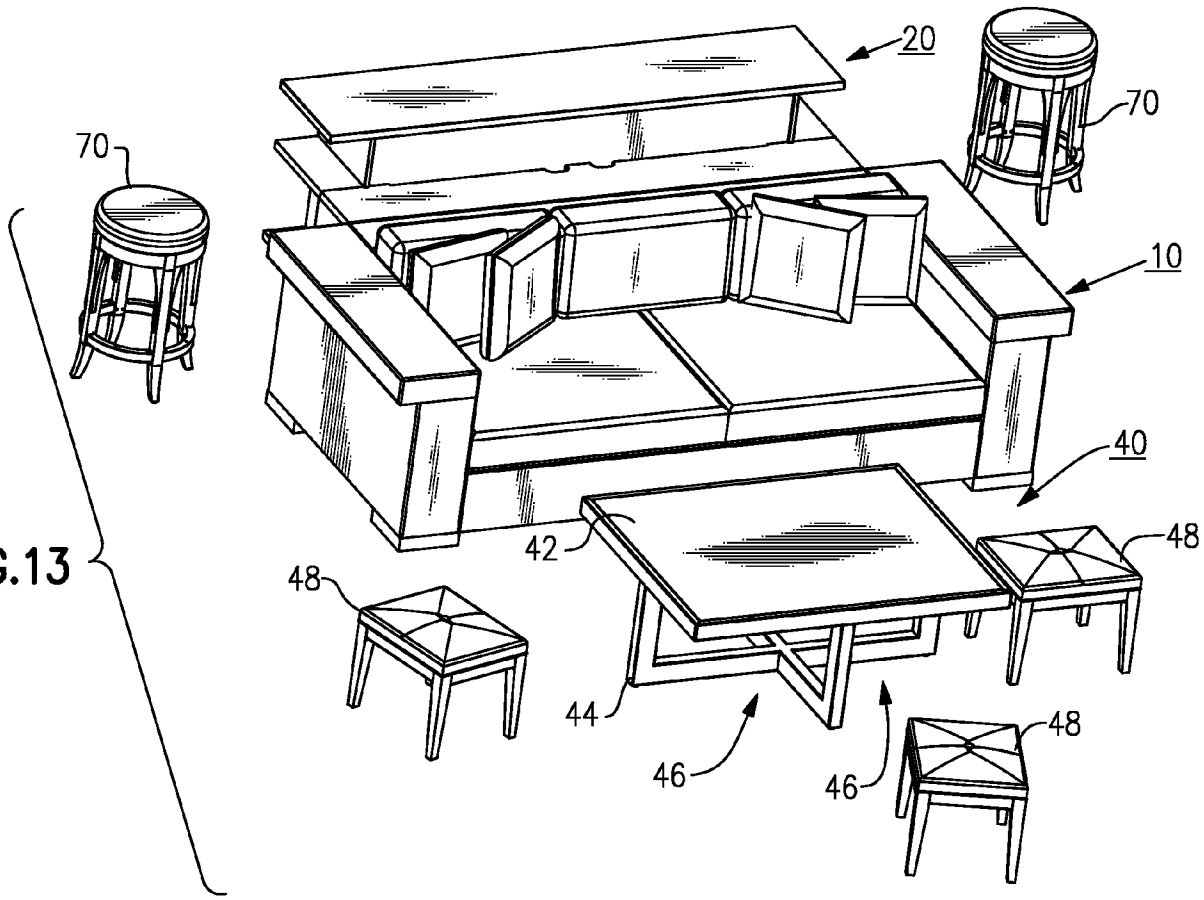
FIG. 13 is a perspective view of the ensemble of furniture of an embodiment that features a cocktail table and footstools that nest beneath it.

Returning now to FIGS. 1 and 2, and referring also to FIG. 13, additional seating units 70, here shown as bar stools, provide seating at a higher level than the seating area 12 of the sofa. These seating units or stools 70 fit into the open space 38 beneath the counter top 28 when they are not needed, but can be easily pulled out the open back for persons to occupy, either behind the sofa table island piece 20, or to the side of it (see FIG. 13) or elsewhere. Here, the units 70 are traditional, backless high-seating stools, but these units could be seating with backs, and in some cases with arms.

The furniture ensemble with a cocktail table 40 instead of the ottoman 18 is shown in FIG. 13. In this embodiment, the cocktail table 40 has a generally square or rectangular top 42, and this is supported on a set of L-shaped legs 44. These legs 44 each have a vertical member that centers on a respective edge of the table top 42, and a horizontal member that meets the other horizontal leg members beneath the center of the cocktail table 40. This arrangement creates four corner receptacles or spaces 46 under the top 42. A set of footstools 48 are provided, generally as illustrated here, which fit in a respective corner space 46 and can be pulled out when needed for additional seating, for example, for younger children.

With the furniture arrangements or ensembles of this invention, as described and illustrated, a space in the room ahead of the sofa 10 and ahead of the ottoman 18 or cocktail table 40, can be an event space, including e.g., a large-screen television, or a Christmas tree, or a recital space (for piano and singer), or for many other occasions where a number of persons may want to gather. Persons may also seat themselves comfortably on the arms 14 of the sofa. In each case, the persons seated behind have a view that is not obstructed by the persons seated ahead of them.

The sofa table island piece 20 makes this possible by creating a table space (i.e., the shelf 26) immediately behind the sofa back 16 to serve the purpose of side tables for persons to put food plates or drink glasses, or to use as a place for smart-phones and tablet devices, and for their charging stations, as well as a place for lamps, floral arrangements, books, or other items. The higher-level counter top 28 provides a work space or table space for persons seated on the stools 70 behind the island piece 20, with the stools being stored within the footprint of the island piece until needed for additional seating. The counter top 28 then provides space for those persons to set food plates, drink glasses, or other items.

The cocktail table 40 with its footstools 48 that nest beneath it, provide further additional seating ahead of the sofa 10 with the seating at a lower level than the sofa seating area 12.

The sofa can be of various width dimensions, selected for the size of the room space, e.g., sofa width of seventy-eight inches or ninety inches. The island piece 20 can then be of a corresponding width dimension so as to match the lower front shelf 26 with the width of the sofa back 14. This in turn means the wider space 38 beneath the wider counter top 28 can store four stools 70, instead of the three shown in the illustrations.

The sofa 10 can be covered with leather, with upholstery cloth, or in some cases can have bare wood arms 14. The sofa table island piece 20 can be made of various woods with a choice of finishes. The overhang at the right and left ends of the shelf 26 and counter top 28 can vary and is not critical.

While the furniture ensemble concept of the present invention has been described with reference to specific preferred embodiments, it should be understood that the invention is not limited to those precise embodiments. Rather, many modifications and variations would present themselves to persons skilled in the art without departure from the scope and spirit of this invention, as defined in the appended claims.

What is claimed is:

1. In combination:

a tuxedo sofa adapted for seating a plurality of persons, and having a seating space, the seating space having a predetermined height and width, arms disposed at left and right sides of the seating space each with a horizontal top surface having a width and a predetermined height above the height of said seating space, and a sofa back disposed behind said seating space and having a horizontal top surface of a predetermined width and a height equal to the height of arm top surfaces;

a two-level sofa table island piece adapted to be disposed behind the sofa back of said tuxedo sofa, the sofa table island piece including left and right side walls; a front horizontal shelf member affixed on said side walls and extending a width distance at least equal to the width of said seating space, and having a height equal to the height of the top surface of the sofa back, so that the front horizontal shelf member of said sofa table island piece is configured to be at the same level as said sofa back top surface when the sofa table island piece is positioned directly behind said tuxedo sofa; a vertical riser wall extending upward a predetermined distance from a rear edge of said front horizontal shelf member; a rear horizontal counter member extending rearwardly from an upper edge of said riser wall and extending laterally a width distance at least equal to the width of said seating space, and having a height greater than the height of said front horizontal shelf member; said side walls and said rear counter member defining an open space between the side walls and beneath said rear counter member and with a back side of the island piece being open; and a plurality of seating units, each having a seat portion supported on a leg portion such that the seat portion is at a given height greater than the predetermined height of the sofa seating space, with said open space of said sofa table island piece being configured for removably storing said seating units therein.

2. The combination of claim 1 wherein said sofa table island piece further includes at least one horizontal shelf mounted on at least one of the side walls thereof at a level below the level of said front horizontal shelf member.

3. The combination of claim 1 wherein said sofa table island piece further includes at least one horizontal shelf mounted on at least one of the side walls thereof at the level of said front horizontal shelf member.

4. The combination of claim 1 wherein the height of the front horizontal shelf member of said sofa table island member is substantially 27 inches, and the height of said rear counter member is substantially 36 inches.

5. The combination of claim 1 wherein the horizontal top surfaces of the arms of said sofa have a width of substantially 12 inches.

6. The combination of claim 1 said sofa table island piece having a cord slot extending along a rear side of said front horizontal shelf member at a junction thereof with said riser wall and defining an elongated narrow space between said front horizontal shelf member and said vertical riser wall that is configured to permit passage therethrough of an electrical power or communications cord.

7. The combination of claim 6 wherein said cord slot has a wide portion therein of greater dimension than the elongated narrow space of said cord slot for permitting passage of a cord connector.

8. The combination of claim 1 further comprising an ottoman adapted to be positioned in front of the seating space of said tuxedo sofa, and having a width and height substantially the same as the width and height of said seating space, respectively.

9. The combination of claim 1 further comprising a cocktail table adapted to be positioned in front of the seating space of said tuxedo sofa, and a plurality of stool members, the cocktail table being configured to define a plurality of nesting spaces beneath a table top thereof in which the stool members can nest and configured to permit the stool members to be pulled out from beneath the cocktail table when needed for additional seating.

10. The combination of claim 9 wherein said cocktail table has a top of generally rectangular shape with four side edges; and four L-shaped leg members that each have an upright member positioned at a center of a respective edge of the top, and a horizontal member that meets the horizontal members of the remaining legs beneath a center of the top.

11. A two-level sofa table island piece configured to be disposed behind a tuxedo sofa that has a seating space, a sofa back rising behind said seating space to a predetermined top height, and a pair of sofa arms, the sofa table island piece comprising:

left and right side walls each having a dual-level top edge that is at a lower level at a front portion and at a higher level at a rear portion thereof;

a front horizontal shelf member affixed on the front portions of said side walls and extending a width distance, and having a predetermined height; a vertical riser wall affixed between said left and right side walls and extending upward a predetermined distance from a rear edge of said front horizontal shelf member; a rear horizontal counter member affixed on the rear portion of said left and right side walls and extending rearwardly from an upper edge of said riser wall and extending laterally a width distance such that the height of said rear horizontal counter member is greater than the height of said front horizontal shelf member; and wherein said side walls and said rear counter member define an open space between the side walls and beneath said rear counter member and with a back side of the island piece beneath said rear counter member being open.

12. The sofa table island piece according to claim 11, wherein the height of said front horizontal shelf member is substantially twenty-seven inches.

13. The sofa table island piece according to claim 11, wherein the height of said rear counter member is substantially thirty-six inches.

14. The sofa table island piece according to claim 11, wherein at least one cable slot extends along the rear edge of said front horizontal shelf member at a junction thereof with said riser wall and defining an elongated narrow space, and adapted to accommodate passage of electrical or communications cables to an interior of the sofa table island piece.

15. The sofa table island piece according to claim 11 further comprising at least one horizontal shelf mounted on at least on of the side walls thereof at the level of said front horizontal shelf member and contiguous therewith.

16. The sofa table island piece according to claim 15 further comprising at least one horizontal shelf mounted on at least one of the side walls at a level below the level of said front horizontal shelf member.

17. The sofa table island piece according to claim 11 wherein said sofa table island piece has an open back, and wherein the open space defined between the side walls and beneath said rear counter member is open across its width and height and is configured for removable storage of one or more additional seating units.

* * * * *